US007121211B2

(12) United States Patent
Beal

(10) Patent No.: US 7,121,211 B2
(45) Date of Patent: Oct. 17, 2006

(54) PROJECTILE HAVING FRANGIBLE TRAILING END BARRIER AND METHOD

(75) Inventor: Harold F. Beal, Rockford, TN (US)

(73) Assignee: Doris Nebel Beal Inter Vivos Patent Trust, Rockford, TN (US)

( * ) Notice: Subject to any disclaimer, the term of this patent is extended or adjusted under 35 U.S.C. 154(b) by 190 days.

(21) Appl. No.: 10/862,551

(22) Filed: Jun. 7, 2004

(65) Prior Publication Data

US 2004/0231551 A1 Nov. 25, 2004

Related U.S. Application Data

(63) Continuation-in-part of application No. 10/075,334, filed on Feb. 14, 2002, now Pat. No. 6,745,698.

(51) Int. Cl.
*F42B 10/00* (2006.01)

(52) U.S. Cl. ..... 102/514; 102/493; 102/494; 102/502

(58) Field of Classification Search ..... 42/514, 42/493; 102/502, 492, 494, 493
See application file for complete search history.

(56) References Cited

U.S. PATENT DOCUMENTS

| | | | | |
|---|---|---|---|---|
| 2,007,026 | A | 7/1935 | Robertson | |
| 2,183,502 | A | 12/1939 | Lefere | |
| 2,382,152 | A | 8/1945 | Jakobsson | |
| 3,170,405 | A | 2/1965 | Jungermann et al. | |
| 3,528,662 | A | 9/1970 | Merchant et al. | |
| 3,820,464 | A * | 6/1974 | Dixon | 102/493 |
| 3,865,038 | A | 2/1975 | Barr | |
| 4,665,827 | A * | 5/1987 | Ellis, II | 102/510 |
| 4,774,745 | A | 10/1988 | Carter | |
| 5,035,183 | A | 7/1991 | Luxton | |
| 5,789,698 | A | 8/1998 | Beal | |
| 6,857,372 | B1 * | 2/2005 | Renaud-Bezot et al. | 102/493 |

* cited by examiner

*Primary Examiner*—Michelle Clement
*Assistant Examiner*—Stewart Knox
(74) *Attorney, Agent, or Firm*—Pitts & Brittian, P.C.

(57) ABSTRACT

An ammunition projectile comprising a metal jacket containing a powder-based core incompletely filling the trailing end of the jacket, and a disc overlying the trailing end of the core within the jacket, the disc being frangible by reason of a plurality of indentations in at least one face of the disc. A method is claimed.

21 Claims, 5 Drawing Sheets

PROJECTILE HAVING FRANGIBLE TRAILING END BARRIER AND METHOD

CROSS-REFERENCE TO RELATED APPLICATIONS

This application is a continuation-in-part of U.S. patent application Ser. No. 10/075,334, filed Feb. 14, 2002 now U.S. Pat. No. 6,745,698, entitled: Projectile Jacket Having Frangible Closed End and Method of Manufacture, such application being incorporated herein in its entirety, by reference.

STATEMENT REGARDING FEDERALLY SPONSORED RESEARCH OR DEVELOPMENT

Not Applicable

BACKGROUND OF THE INVENTION

This invention relates to gun ammunition projectiles and particularly to frangible projectiles and more particularly to frangible projectiles for use in pistol or rifle ammunition of 50 caliber or smaller.

In the art there exists a major concern relating to the danger associated with ricocheting projectiles fired from guns, especially from pistols and rifles of 50 caliber or smaller calibers. Major litigation has arisen seeking monetary recovery from law enforcement officers and/or governmental agencies as compensation from injury to a bystander or other innocent person struck by a ricocheting projectile or portion of a projectile. Also importantly, ricocheting projectiles are a very present danger to fellow law enforcement officers when gunfire erupts within a closed area, such as border patrol officers inspecting the holds of ships for contraband, etc. Further, training of law enforcement officers commonly includes participating in exercises which include entry into a "live fire house". These exercises involve rapid entry by a number of officers into a "live fire house" training building and live firing of weapons at designated targets within the building. The presence of several officers within the enclosure, each of which may be firing their weapon, generates a real danger of injury of an officer by reason of their being struck by a ricocheting portion or all of a projectile.

Projectiles of the prior art have almost exclusively included a lead core, either with or without an outer covering of the core. In either event, lead has been recognized as an environmental pollutant and is now either banned or being considered for banning, in gun ammunition projectiles. Moreover, lead projectiles tend to ricochet from many surfaces which have a hardness on the order of a hardwood or even from the ground.

Accuracy of delivery of a projectile to an intended target is of importance in any shooting situation, but is of great importance in competitive sport shooting and in certain military and/or law enforcement shooting situations. Of especial concern is the repeatability from projectile to projectile of accuracy of delivery of the projectiles to a target.

To solve both the environmental concerns and the ricochet tendency of lead projectiles, there have been developed projectiles formed from a combination of materials which are collectively frangible when the projectile strikes a solid or semi-solid target. In those instances where these newer projectiles include a core which is housed within a jacket, such as copper, brass or other metal or metal alloy, the frangibility of the jacket is of concern. For example, fragments of the jacket may ricochet off an intended or unintended target and become independent small projectiles which can be injurious to an unintended target, such as a bystander or even the shooter. Depending upon various factors such as distance, outerwear protection, size of fragment, etc., such fragments can be lethal.

The present inventor has found that dislodgement and escape of powder particulates from the trailing end of a powder-based core exposed to the heat and blast forces generated by the burning powder within the case of a round of ammunition create at least two deleterious effects.

First, the center of gravity of the projectile is altered by the loss of the dislodged powder particles. The quantity of particles dislodged is different from projectile to projectile so that there is no consistency in the degree of alteration of the center of gravity between projectiles. This unpredictable alteration of the center of gravity of the projectile causes the projectile to exhibit more or less tendency to "yaw" along its free flight path to a target, with resultant inaccuracy of delivery of the projectile to the target. This problem, in its more severe state, can actually lead to the projectile assuming a tumbling action during its free flight to a target.

Second, in those instances where the powder-based core of the projectile is incorporated into a metal jacket and the initially open end of the jacket becomes the trailing end of the projectile, upon the projectile being fired down the barrel of the weapon, the trailing end of the core is exposed to the blast of the burning gun powder held within the case in which the projectile is disposed. Unless this initially open trailing end of the jacket is closed by some means, it has been found that individual particulates of the powder-based core break away from the core and exit the unclosed open end of the jacket. Such particulates, especially when they comprise a heavy metal, such as tungsten, etc., have further been found to affect damage to the bore of the barrel of the weapon, and in some instances, affect physical injury to personnel who may be disposed adjacent the muzzle of the weapon at the time it is fired. The hazardous nature of such loose powder particulates (which may comprise a grouping of multiple individual powder particulates bound together into a larger missile) has prompted the establishment of a test for powder-based projectiles which provides a type of measure of the quantity and/or size of loose powder particulates exiting the muzzle of the weapon and striking a sheet of paper positioned substantially perpendicular to the flight path of the projectile and at a distance of about ten feet from the muzzle of the weapon. This test provides information as to the density of loose powder particles exiting the weapon, the size of individual ones or groups of particles, and their spatial relationship to the actual flight path of the projectile.

It has been proposed that prevention of the release of powder particulates from the trailing end of a jacketed powder-based projectile may be affected by incorporating within the jacket a solid metal closure disc that is placed within the jacket in overlying relationship to the trailing end of the powder-based core, and thereafter the rim of the open end of the metal jacket is folded radially inwardly of the jacket to engage and anchor the solid metal disc within the jacket. Whereas this proposed procedure can be effective to block the egress of loose powder particulates from the trailing end of the projectile, it presents a more serious problem in that the solid metal disc does not readily disintegrate when the projectile strikes a solid or semi-solid target. Rather, the solid metal disc becomes a potentially lethal missile in and of itself and therefore presents a hazard which can be more serious than the hazard associated with individual powder projectiles.

SUMMARY OF INVENTION

In accordance with the present invention, there is provided a barrier disposed within the initially open end of the jacket in overlying relationship to the flat trailing end of a powder-based core disposed within the jacket, such barrier comprising a solid, preferably metal, disc which has been indented on at least one of its initially planar faces, with a multiplicity of indentations into the thickness of the disc prior to insertion and anchoring of the disc within the jacket. In accordance with the present invention, these indentations are spaced apart from one another over substantially the entire area of at least one face of the disc. Such indentations have been found to both weaken the disc at multiple locations over the area of an initially flat face of the disc and to impart multiple stressed areas within the disc, thereby rendering the disc frangible when the projectile strikes a solid or semi-solid target.

Accordingly, the indentations preferably extend from a face of the disc into the thickness of the disc by a distance equal to between about 20% and about 75% and preferably not than more about 50% of the thickness of the disc, but not so deep into the disc as to permit the disc to disintegrate due to the forces exerted against it when the projectile is fired from a weapon. The depth of the indentations is partially a function of the mechanical properties of the material from which the disc is formed. Whereas the size and geometry of the individual indentations may vary over relatively large ranges, it is preferred that the indentations be substantially uniformly sized and substantially uniformly spaced over substantially all of the area of at least one initially flat face of the disc. Further, in one embodiment of the present invention, indentations may be provided on both of the opposite faces of the disc, as desired.

DETAILED DESCRIPTION OF THE INVENTION

In accordance with one aspect of the present invention, there is provided a projectile 12 for ammunition for a small bore weapon, i.e. a rifle or pistol of .50 caliber or smaller caliber. The projectile of this invention is powder-based, that is, all or the bulk of the projectile is formed from a blend of metal powders which, when blended, commonly exhibit a density equivalent to or greater than the density of lead, but may be less than the density of lead.

Figure 1:
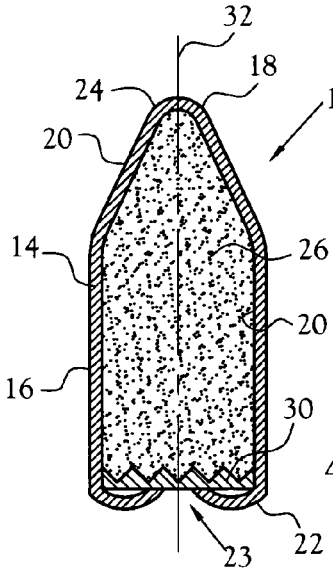
FIG. 1 is a side view, in section, of one embodiment of a metal jacketed projectile incorporating therein a barrier disc of the present invention.
Figure 2:
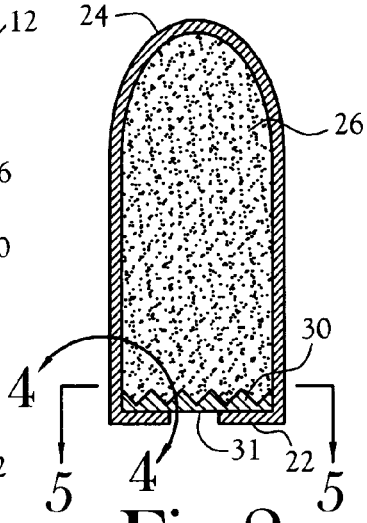
FIG. 2 is a side view, in section, of another embodiment of a jacketed projectile incorporating therein a barrier disc of the present invention.
Figure 3:
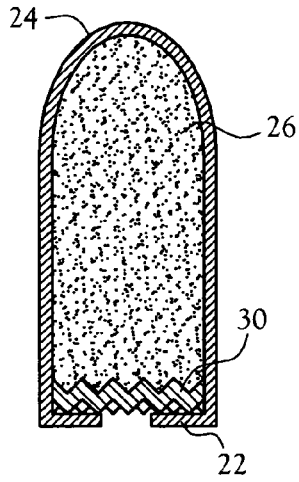
FIG. 3 is a side view, in section, of a further embodiment of a jacketed projectile incorporating therein a barrier disc of the present invention.
Figure 4:
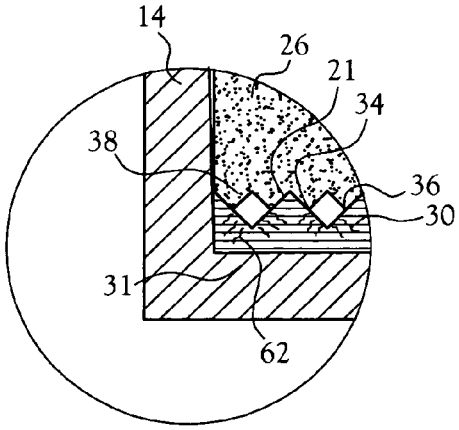
FIG. 4 is a partial view, in section, of the left bottom corner of the projectile depicted in FIG. 2 and taken generally along the line 4—4 of FIG. 2.

With reference to FIGS. 1–3, there are depicted three embodiments of a projectile embodying various of the features of the present invention. In FIG. 1 there is depicted, in sections, a projectile 12 suitable for firing from a rifle, for example. This projectile includes an outer jacket 14 which includes a generally cylindrical body portion 16 of substantially uniform wall thickness, a tapered closed leading end 18 defining an ogive 20, and an open trailing end 23. In the embodiment depicted in FIGS. 1–3, a core 26 made up of a cold-compacted quantity of a blend of a heavy metal powder such as tungsten metal powder and a relatively light metal powder, such as tin metal powder, is disposed within the jacket and substantially fills the interior volume of the jacket aside from a relatively small portion 22 of the jacket interior adjacent the trailing end 23 of the projectile (See FIG. 13). The quantity of the blended powder mixture is preferably cold-compacted, e.g. at room temperature, for example, in a die to form the self-supporting core 26. In the embodiment depicted in FIGS. 1–3, the core is formed to geometrically conform to the interior wall of the jacket.

FIGS. 1–13 depict a typical cup-shaped jacket 14 having an open trailing end 23 and a closed leading end 24 as employed in the manufacture of a projectile for gun ammunition. The depicted jacket is chosen to illustrate the present invention when manufacturing projectiles such as those depicted in FIGS. 1–3, but it is to be recognized that other caliber projectiles, of different outer geometries, etc., for either pistols or rifles of .50 caliber or smaller, may be manufactured employing the present invention and will exhibit the novel features referenced herein. The depicted jacket may be formed from a metal such as copper, or a metal alloy such as brass or other ductile metal or metal alloy, is thin-walled, e.g., having a wall thickness of about 0.013", is open at one end 23 and is closed at its opposite end 24 to define an interior surface 20. In most instances, depending upon its mode of manufacture, the wall thickness of the jacket adjacent its closed end may increase by a few thousandths of an inch as compared to the wall thickness of the jacket adjacent its open end. The closed end or base of the jacket is commonly about 0.030" thick.

As seen in FIGS. 1–4, there is further included within the jacket a barrier disc 30 of the present invention. Prior to indentation, this disc 30 is initially of substantially uniform thickness and density throughout the disc. Prior to insertion into a jacket, at least one of its opposite faces is indented to define a plurality of indentations 34 which define outwardly extending projections 54 that are disposed adjacent to and engaging the end surface 36 of the trailing end 38 of the core. Within the jacket, the disc is oriented with its opposite faces 29 and 31 normal to and concentric with the longitudinal centerline 32 of the jacket. The disc further is of a diameter which is only slightly, e.g. a few thousandths of an inch, smaller than the internal diameter of the open trailing end of the jacket so that the disc will readily enter the open end of the jacket and snugly fit within the jacket.

The barrier disc of the present invention is necessarily heat and pressure resistant for protecting the core from the heat and pressure generated by burning gunpowder. In smaller caliber projectiles, e.g. .22 caliber, the heat and pressure experienced is less than the heat and pressure experienced by larger caliber projectiles such as .50 caliber projectiles. Tin, copper and various metal alloys, such as brass, having heat and pressure resistance substantially equivalent to these same properties of tin, copper or brass are suitable candidates for the barrier disc of the present invention. Tin is preferred for smaller caliber projectiles and copper or brass is preferred for the larger caliber projectiles. The thickness of the disc can vary, the major determinant of thickness being the ability of the disc to retain its integrity and shape when subjected to the heat and pressure associated with the burning gunpowder employed in a given round of ammunition. By way of example, in a 9 mm pistol projectile, a tin barrier disc of 0.750 inch thickness is suitable.

Figure 16:
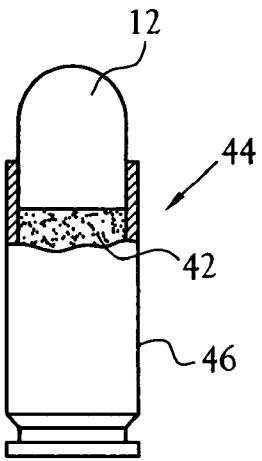

As noted, a relatively short length 22 of the trailing end of the jacket, e.g. a length of jacket which is a length not greater than a radius of the cylindrical portion 16 of the jacket, is folded inwardly, e.g. swaged, toward the longitudinal centerline 32 of the jacket and into contact with the rear face 31 of the disc, thereby anchoring the disc and the core within the jacket. Importantly, the disc covers the end surface 36 of the trailing end 38 of the core so that none of the core is exposed exteriorly of the jacket. As so disposed, the disc is in position to serve as a barrier against the heat and blast forces which are exerted against the trailing end of the projectile upon ignition and burn of the gun powder 42 of a round of ammunition 44 which includes the present projectile 12 in the open end of a case 46 as depicted in FIG. 16, thereby preventing the dislodgement and escape of powder particulates from the open end of the projectile during the firing and flight path of the projectile to a target.

Figure 5:
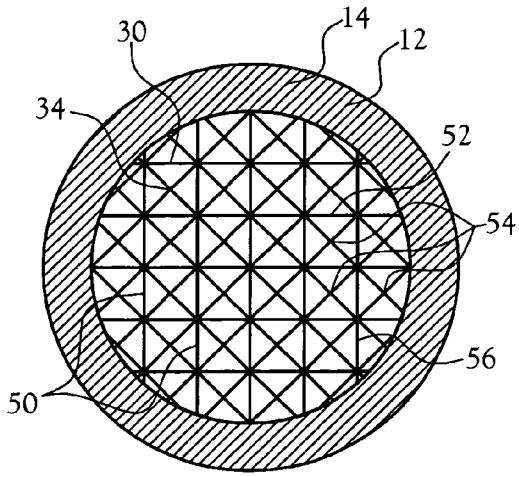
FIG. 5 is a sectional plan view taken generally along the line 5—5 of FIG. 2.
Figure 6:
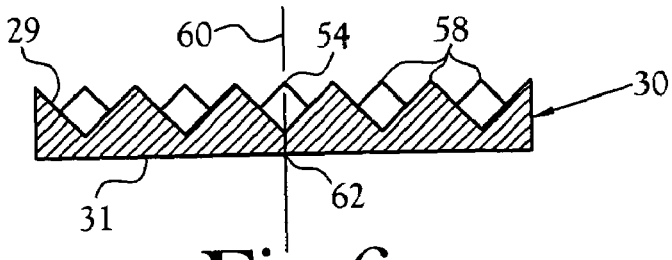
FIG. 6 is side view, in section, of one embodiment of barrier disc incorporating various of the features of the present invention.
Figure 7:
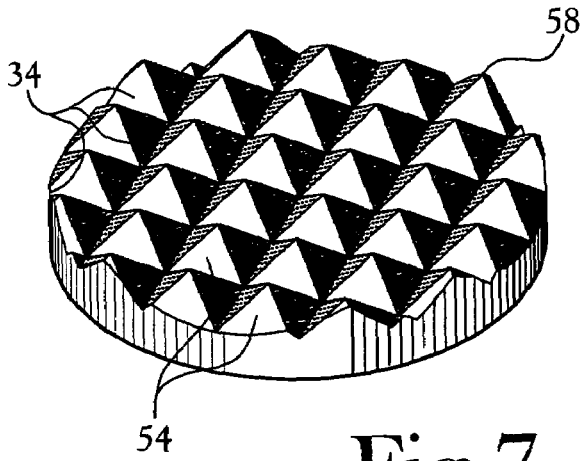
FIG. 7 is perspective view of a barrier disc embodying various features of the present invention.

FIGS. 5–7 are enlarged views of one embodiment of an indentation pattern formed in that face 29 of the disc 30 which faces the trailing end 38 of the core. The pattern of indentations depicted in FIGS. 5–7 comprises a square pattern of parallel side-by-side, equally spaced apart, vertical elongated indentations 50 which are perpendicularly intersected by a plurality of parallel side-by-side, equally spaced apart, horizontal elongated indentations 52 formed in the face 29 of the disc. Each elongated indentation is of a generally triangular cross-section so that a pyramidal projection 54 (typical) is defined at each of the intersections of the several side-by-side vertical and horizontal elongated indentations. The base 56 of each pyramidal projection faces inwardly of the disc thickness and is preferably interconnected to the bases of each of its neighboring pyramidal projections. The apices 58 of the pyramidal projections terminate distally of the face of the disc.

In a preferred embodiment, the individual indentations and resulting projections are each of like size and shape, thereby lending uniformity of distribution of the pyramidal projections over substantially the entire surface of the disc. The pattern of indentations into the disc may assume any of many geometrical configurations, including differently sized and/or shaped indentations in a given pattern, so long as the indentations are substantially uniform in size and shape and distribution radially of the central axis 60 of the disc.

It will be recognized that the intersecting indentations define points of weakness of the disc at their intersections, thereby causing the disc to disintegrate into multiple very small fragments (each fragment approximating a pyramidal projection in size) upon the projectile containing the disc striking a solid or semi-solid target. Such relatively minute fragments, when separated from the disc, lose their velocity almost immediately, falling harmlessly away from the struck target.

In a preferred embodiment of a disc for forming a .223 caliber rifle projectile, the disc 30 is of about 0.030" thickness prior to indentation. In this embodiment, the depth of penetration of each of the indentations 26 into the thickness of the disc is about 0.015", thus defining a height of about 0.015" for each pyramidal projection 54, and leaving about 0.015" of thickness of the disc intact over the area of the face 31 of the disc. Preferably, in accordance with one aspect of the present invention, it is desired that the number of indentations be maximized, taking into consideration, among other things, the extent to which the indentations lessen the tensile strength of the disc, thereby maximizing the number of sites of fracture of the disc upon the projectile striking a target. By way of example, between about 24 and 48 indentations have been found to provide the desired disintegration of a disc for a .223 projectile jacket. Moreover, the total area of the face of the disc which is covered by the total area of the indentations preferably is between about 80% and about 99% of the total area of the disc face, i.e., the indentations may be slightly separated from one another or they may have common outboard perimeters between adjacent indentations.

Preferably the depth of the indentations into the disc extends to about 50% of the thickness of the disc. The indentation may extend into the thickness of the disc a distance equal to between about 20% and about 75% of the thickness of the disc, leaving intact sufficient thickness of the disc as will withstand firing of the projectile to a target without disintegration prior to striking the target.

Further referring to FIG. 6, there are depicted multiple stress lines 62 (typical), which develop within the disc upon the indentation into the disc. These stress lines represent avenues along which a fracture originating between or within adjacent ones of the pyramidal projections may propagate into the intact unindented portion of the disc upon the projectile striking a relatively hard surface. These stress lines thus function to further enhance the disintegration of the disc into fragments which are sufficiently small as to possess insufficient energy as to present a danger to persons or property located near a target impacted by a projectile of the present invention.

Figure 8:
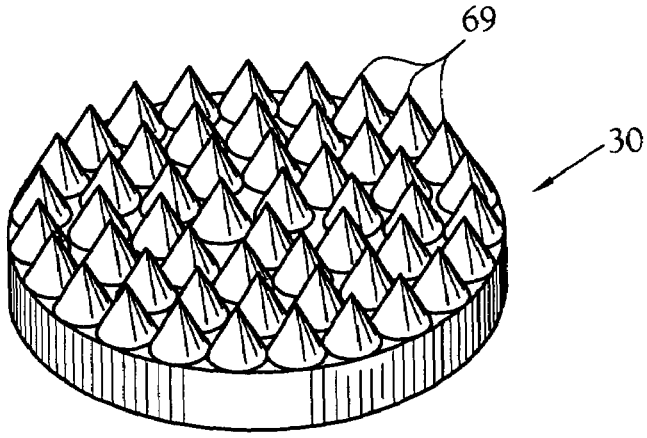
FIG. 8 is a top plan view of an alternative embodiment of a barrier disc embodying various features of the present invention.
Figure 9:
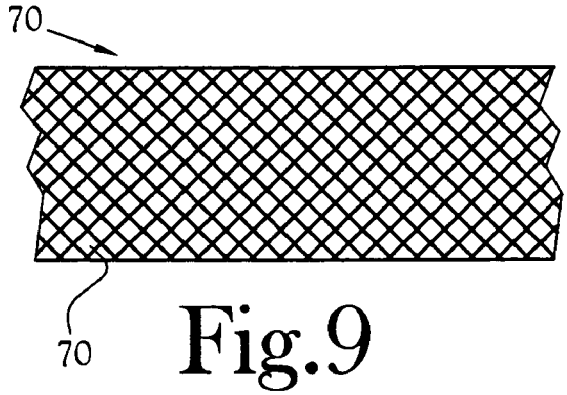
FIG. 9 is a top view of a strip of metal which has been indented in accordance with one embodiment of the present invention.

Whereas pyramidal indentations into the thickness of the disc are most suitable, other geometric configurations of the indentations are acceptable, for example, indentations having a cross-section of rhomboidal or diamond geometry or a mixture of geometric configurations as will be recognized by one skilled in the art. Likewise, the pattern of the indentations may vary quite widely. By way of example, FIG. 8 depicts a disc 30 having a plurality of conical projections 69 formed over the face 29 of the disc. Preferably, the pattern of indentations provides for indentations over substantially the full area of the disc. In any event, it is desired that a maximum number of side-by-side indentations be provided, and that these indentations extend substantially fully over the area of the disc surface, thereby ensuring frangibility of all portions of the disc into harmless fragments. Further, desirably the indentations are uniform in geometry and spacing radially from the longitudinal central axis 60 of the jacket over the overall surface of the disc to avoid creating an imbalance of spin stability of the projectile about its longitudinal axis, when fired from a gun.

Figure 10:
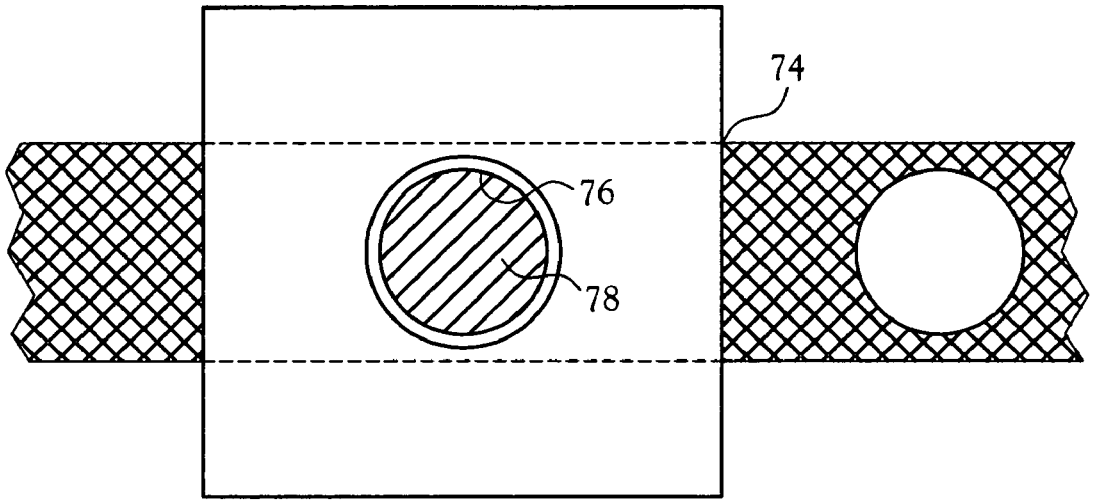
FIG. 10 is a top view of a die-punch device for punching a barrier disc from the strip of metal depicted in FIG. 9.
Figure 11:
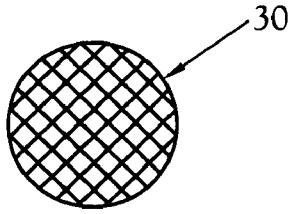
FIG. 11. is a top view of a barrier disc which has been punched out of the strip of metal depicted in FIG. 9.
Figure 12:
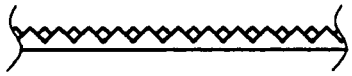
FIG. 12 is side view of a section of an indented strip of metal as depicted in FIG. 9 and preparatory to the punching of a barrier disc therefrom.

One embodiment of apparatus and a method for the production of the disc useful in the present invention is schematically depicted in FIGS. 9–12. In this embodiment, a strip 70 of copper metal of about 0.030" thickness which has had one of its flat faces indented with mutually perpendicularly intersecting individual pyramidal indentations, such as depicted in FIG. 7, is fed into a die 74 having a circular opening 76 through the thickness of the die. A cylindrical punch 78 is pushed through the circular opening to punch out a disc 30 as shown in FIG. 11. Formation of the indentations in the face of the disc may be effected by any of several well-known techniques. In Applicant's copending application, there is disclosed a die and punch technique for forming the indentations. Other techniques included feeding of the strip of copper metal through the nip between a smooth roll and a second roll having its surface provided with pyramidal projections which are forced into the thickness of the metal strip, thereby defining the projections illustrated in FIG. 7, for example.

Figure 13:
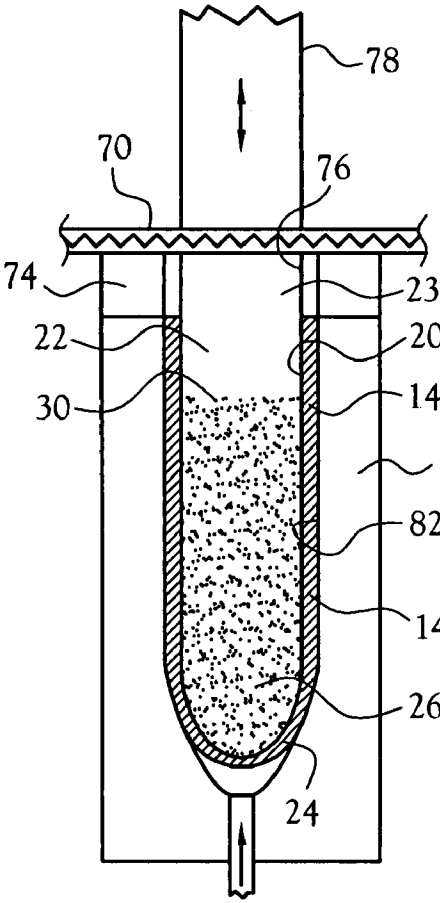
FIG. 13 is a schematic side view of a die-punch device for punching a barrier disc from an indented strip of metal preparatory to the deposit of such disc in a metal jacket containing a powder-based core and held in a die cavity.
Figure 14:
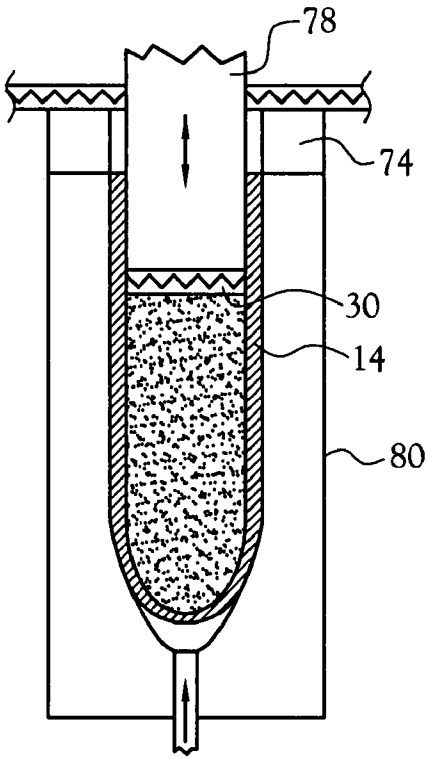
FIG. 14 is a further schematic view of the die-punch device depicted in FIG. 13 and depicting a punched-out barrier disc deposited within a metal jacket as depicted in FIG. 13.

In FIGS. 13–16, there is schematically depicted a further embodiment of apparatus and method for both forming a disc and insertion of the same into a jacket containing a core. This further embodiment comprise a second die 80 disposed underneath a first die as depicted in FIG. 10. This second die includes a cavity 82 suitable for receiving therein a jacket 14 having a powder-based core 26 disposed therein, the open end 23 of the jacket being in register with the circular opening in the first die. Thus, upon the disc being punched out of the strip 70 of indented copper, the disc is further pushed down into the open end 23 of the jacket and into overlying and covering relationship to the trailing end 38 of the core as best seen in FIG. 13.

Figure 15:
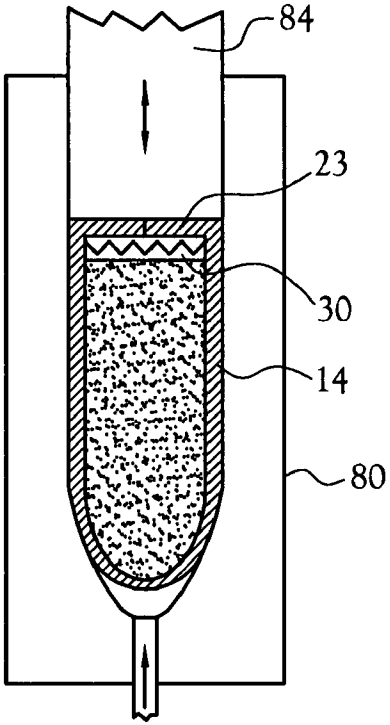
FIG. 15 is a schematic view of a further die-punch device for radially infolding of the rim of the open end of a metal jacket containing a powder-based core and a barrier disc of the present invention for anchoring the core and disc within the jacket; and, FIG. 16 is a schematic representation of a round of gun ammunition having incorporated therein a projectile embodying various of the features of the present invention.

Referring to FIG. 15, closure of the open end of the jacket is effected by means of a second punch 84 radially inwardly folding the rim portion 22 of the jacket over onto the disc to lock the disc and core within the jacket. As desired, but not depicted, the closure operation may be carried out in multiple stages wherein the rim of the open end of the jacket is first folded partially radially inwardly toward the longitudinal centerline of the jacket and thereafter the infolding is completed in a further step. As depicted in FIG. 15, the infolded rim portion of the jacket fully covers the disc, but as seen in FIGS. 1–3, the infolded rim portion need not necessarily cover the entire surface of the disc.

Whereas the present invention has been described employing specific examples and dimensions, it will be recognized by one skilled in the art that modifications or other embodiments of certain elements of the invention may be altered without departing from the concepts of the invention. In particular, it will be recognized that the pattern of indentations imparted to the disc may assume different geometries and may include more or fewer indentations per unit area of the disc without losing the desired frangibility of the jacket. Further, as noted each indentation need not necessarily be of the same size as others of the indentations, nor of the same geometry as others of the indentations. For example, where the rows of indentations cross one another at angles other than 90 degrees, the cross section of one or more of the indentations may be of a rhomboid or diamond geometry. It is therefore intended that the invention be limited only as set forth in the claims appended hereto.

Figure 17:
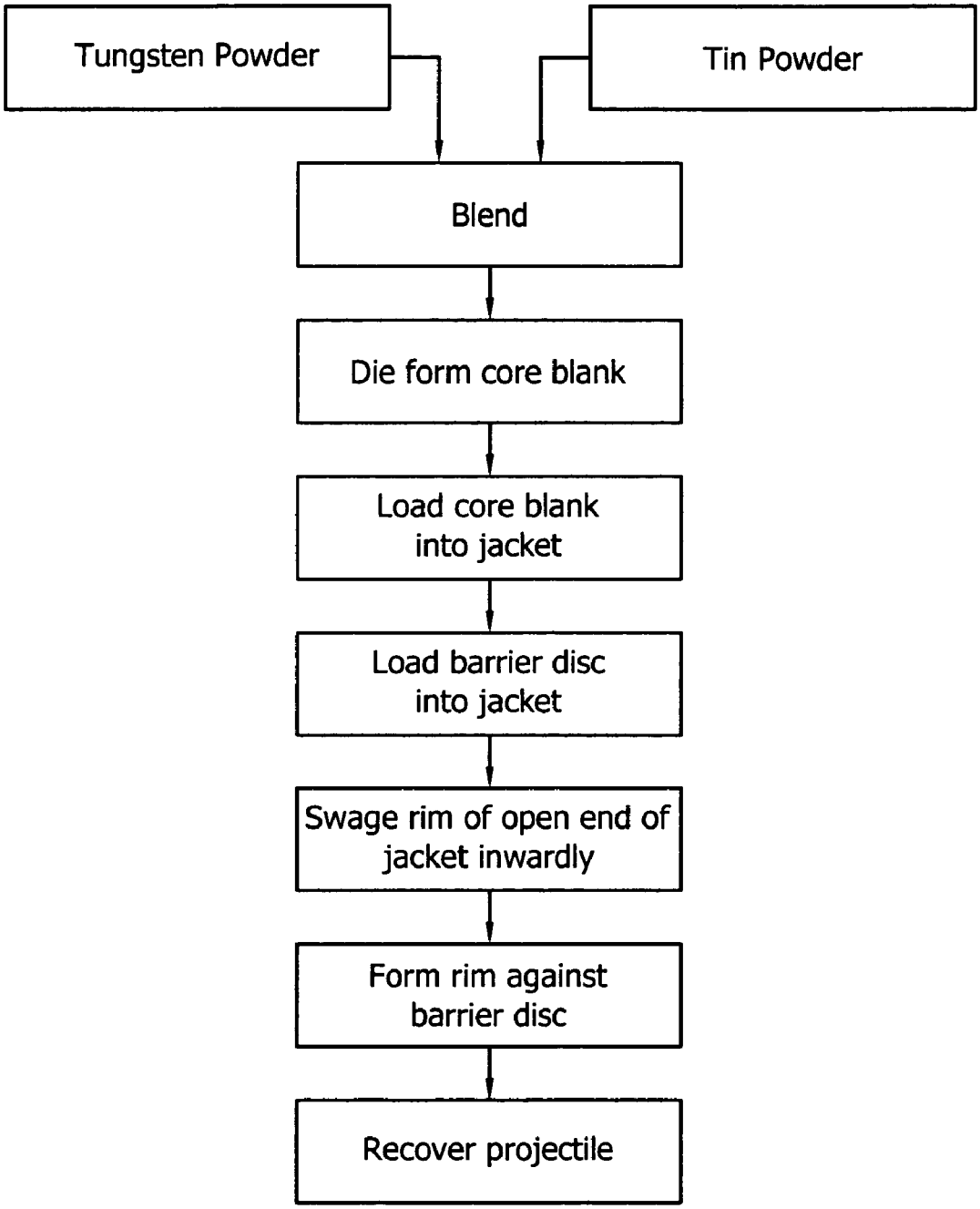
FIG. 17 is a diagrammatic flow chart of the several steps for carrying out one embodiment of the method of the present invention.

With reference to FIG. 17, in one embodiment of the method of the present invention, tungsten and tin powdered metals are blended and a quantity of the blended powdered metals is die-formed to define a core. This core is loaded into a jacket through the open end of the jacket. Thereupon a barrier disc in accordance with the present invention is inserted into open end of the jacket and into contiguous relationship to the core. The open end of the jacket is thereupon swaged inwardly of the central axis of the jacket to form a rim against the disc and capture the core and disc within the jacket. The competed projectile is recovered for further processing into a round of ammunition as is known in the art.

What is claimed:

1. In a jacketed frangible ammunition projectile including a jacket initially of a generally cup-shaped hollow cylindrical geometry and having a closed end and an open end, a powder-based core disposed within the jacket with its trailing end disposed adjacent the open end of the jacket, and a disc having opposite faces, overlying the trailing end of the core in covering relationship thereto, the improvement comprising a plurality of indentations extending into the thickness of the disc from at least one face thereof said indentations being disposed substantially uniformly over the total area of the face of the disc.

2. The improvement of claim 1 wherein said indentations extend into the thickness of the disc a distance equal to between about 20% and about 75% of the thickness of the disc.

3. The improvement of claim 1 wherein said indentations extend into the thickness of the disc a distance not greater than about 50% of the thickness of the disc.

4. The improvement of claim 1 wherein said indentations are defined by a pattern of intersecting parallel, side-by-side elongated indentations which extend substantially fully across the area of said at least one face of the disc.

5. The improvement of claim 1 wherein said indentations are each of substantially like geometry.

6. The improvement of claim 4 wherein said intersecting elongated indentations define generally pyramidal projections which extend outwardly from at least one face of the disc.

7. The improvement of claim 1 including a pattern of indentations extending into the thickness of the disc from each of the opposite faces of the disc.

8. The improvement of claim 1 wherein said indentations extending into the thickness of the disc define a plurality of conical projections extending away from at least one face of the disc.

9. A projectile for gun ammunition comprising a jacket of generally hollow cylindrical cup-shape and having an open end and an opposite closed end, a powder-based core disposed within said jacket and having a trailing end disposed adjacent said open end of said jacket, a disc having first and second opposite generally planar faces disposed within said jacket in overlying and covering relationship to said trailing end of said core, and a plurality of indentations extending into the thickness of said disc from at least one face of said disc, said core and said disc incompletely filling said hollow jacket, leaving a rim portion of said open end of said jacket void of said core and said disc, said rim portion of said jacket being folded radially inwardly of said jacket into locking engagement with said disc, whereby said open end of said jacket is closed against the escape of powder particularlates of said core out of said jacket prior to said projectile striking a target, said disc disintegrating into harmlessly-sized fragments upon said projectile striking a solid or semi-solid target.

10. The projectile of claim 9 wherein said indentations extend into the thickness of said disc a distance not greater than about 75% of the thickness of said disc.

11. The projectile of claim 9 wherein said indentions extend into the thickness of said disc a distance equal to between about 20% and about 75% of the thickness of said disc.

12. The projectile of claim 9 wherein said indentations are disposed according to a pattern of intersecting parallel, side-by-side elongated indentations which extend substantially fully across said at least one face of said disc.

13. The projectile of claim 9 wherein said indentations are disposed substantially uniformly over said at least one face of said disc.

14. The projectile of claim 9 wherein said indentations are disposed substantially over the area of each of said first and second opposite faces of said disc.

15. A method for the formation of a gun ammunition projectile which substantially disintegrates into harmless fragments upon the projectile striking a target comprising the steps of disposing a powder-based core within a cup-shaped jacket having a closed end and an initially open trailing end, said core including a trailing end which is disposed adjacent said open trailing end of said jacket and incompletely filling said open end of said jacket, leaving a portion of said jacket projecting beyond said trailing end of said core, providing a disc having opposite generally planar faces and including a plurality of indentations extending into the thickness of said disc from at least one face of said disc, depositing said disc into said open end of said jacket with said disc being positioned in overlying and covering relationship to said trailing end of said core and incompletely filling said open end of said jacket, thereafter infolding said unfilled portion of said jacket back upon said disc to lock said disc and core within said jacket.

16. The method of claim 15 and including the step of providing indentations extending into the thickness of said disc from each of said opposite faces of said disc.

17. The method of claim 15 wherein said indentations extend into the thickness of said disc a distance of between about 20% and 75% of the thickness of said disc.

18. The method of claim 15 wherein said indentations are uniformly spaced relative to one another and extend over substantially the full area of said at least one of said faces.

19. The method of claim 15 wherein said indentations comprises a first plurality of parallel, side-by-side, elongated indentations which perpendicularly intersect with a second plurality of parallel, side-by-side, elongated indentations to define a plurality of uniformly spaced projections extending outwardly from at least one face of said disc.

20. The method of claim 19 wherein each of said projections is a pyramidal geometry with their respective apices extending in a direction away from said at least one face of said disc.

21. The method of claim 15 wherein said plurality of indentations defines a plurality of projections extending away from said at least one face of said disc.

* * * * *